US005148906A

United States Patent [19]

Brunn

[11] Patent Number: 5,148,906

[45] Date of Patent: Sep. 22, 1992

[54] CURVED ESCALATOR

[76] Inventor: Erik Brunn, Annenweg 130, 2870 Delmenhorst, Fed. Rep. of Germany

[21] Appl. No.: 780,278

[22] Filed: Oct. 18, 1991

[30] Foreign Application Priority Data

Nov. 17, 1990 [DE] Fed. Rep. of Germany ..... 4036667

[51] Int. Cl.[5] ..... B66B 21/00

[52] U.S. Cl. ..... 198/328; 198/332

[58] Field of Search ..... 198/328, 332, 778, 831, 198/334

[56] References Cited

U.S. PATENT DOCUMENTS

| | | | |
|---|---|---|---|
| 2,163,693 | 6/1939 | Margles | 198/332 |
| 4,809,840 | 3/1989 | Nakatani | 198/328 |
| 5,009,302 | 4/1991 | Sansevero | 198/328 |
| 5,033,606 | 7/1991 | Matoba et al. | 198/328 |

FOREIGN PATENT DOCUMENTS

| | | | |
|---|---|---|---|
| 3839974 | 5/1990 | Fed. Rep. of Germany | 198/328 |

*Primary Examiner*—Joseph E. Valenza
*Assistant Examiner*—Cheryl L. Gastineau
*Attorney, Agent, or Firm*—Perman & Green

[57] ABSTRACT

A circular escalator which compensates the different angle velocities of the inner and outer step edges in the transition and landing zones of the escalator to maintain the axis (29) of each step (21) exactly radial to the path of travel (1) so that dangerous gaps are not formed between the steps. The invention avoids such gaps by running driving chains (24) on the main track (25), and connecting the inner and outer edges of the steps (21) to the chains via rotatable connecting rods (23). Each step (21) is joined via a vertically rotatable connecting rod (23) to chain links of the driving chain (24). The main track (25) describes a different path to the step track (27) in the transition zone (1*b*) and in the landing zones (1*c*). The vertical distance between the main track (25) and the step track (27) is proportional to the cosine of the inclination of the path of travel (1), the path difference Δs on the main track and the length L of the connecting rod (23). The length L can have a defined value between the vertical distance between the main and step tracks and the double step width.

5 Claims, 6 Drawing Sheets

CURVED ESCALATOR

BACKGROUND OF THE INVENTION

1. Field of the Invention

The present invention relates to an improved curved escalator or moving stair construction having a path of travel which is curved, when viewed in plan, and having a mid-section of constant inclination, upper and lower landing zones having virtually no inclination, and transition zones which connect the mid-section with the upper and lower landing zones and ensure a smooth connection of these zones of varying inclination. A plurality of horizontally moving steps can be present in the upper and lower landing zones. A plurality of cleated steps which are moveable along the path of travel form gaps in the transition zones and the horizontal zones. Driving chains, consisting of a plurality of chain links, move the steps along outer and inner arced tracks.

2. Description of the Prior Art

A curved escalator of the above mentioned type is known from DE-OS 3437369. In this case however it is not possible in all zones and especially in the transition zones to describe a perfect arc. Furthermore, gaps are formed between the steps and also between the steps and the side walls during movement of the steps.

In order to build a circularly curved escalator it is necessary to compensate the different angular velocities of the inner and outer step edges in the transition and landing zones. Otherwise dangerous gaps could occur between the individual steps.

The object of this invention is to eliminate the above mentioned disadvantages and to construct an escalator which describes an exact circular path with minimum gap-width between the steps and without gaps between steps and the side walls.

SUMMARY OF THE INVENTION

The present invention provides an improved curved escalator structure in which the steps and chains travel different distances in the transition and landing zones and thus, while the horizontal velocities are variable, the angular velocity of the inner and outer path is uniform.

The steps and chain are so constructed that, during movement, a vertical displacement towards the step is possible, whereby the chain describes a path different from that of the step.

Furthermore, the vertical displacement of a connecting rod, which connects the step and the chain, results in a rotation so that the step is moved proportionally to the cosine of the angle of the movement in the direction of movement of the chain.

The control of the steps, according to the invention, permits escalators with very small radii of, for example, 2.0 m and less to be built, which describe exact arcs and form no gaps.

The length of the connecting rods can be about 500 mm for very small and steep escalators (radius 2.O m, inclination 35°) and can be about 70 mm for very large and gradual escalators (radius 7.0 m, inclination 27°).

Furthermore escalators built according to this invention encounter very little wear since only very small additional forces act on the rollers.

Since the connection between chain and step is via a connecting rod, a simple mechanical construction, no exceptionally large forces are encountered, as compared to conventional escalators.

An exact circular path of the steps can be achieved according to the equation:

$$H=(bi\cdot Ri-ba\cdot Ra)\cdot(2\cdot connecting\ rod\ length-1)$$

where H=distance between the main and step track. The distance is constant in the zone la of the path of travel. The equation uses the symbols described in the equation description, whereby in FIG. 7, 1 is the path of travel, ba is the planar arc of the outer path, and bi is the planar arc of the inner path, both measured from the beginning of the landing zone 1*c*.

The arrangement of the main track and the step track perpendicular to each other provides a very compact and elegant structure. It is essential that the driving chains are moveable in all directions so that the step rollers are guided correctly on the step track.

The ability of the connecting rod to perform a circular movement perpendicular to the movement of the steps permits the guidance of the main track above and below the step track, thus easing the returning of the step to the bottom of the escalator.

When the main track and the steps are not perpendicular but are horizontally displaced and connected via connecting rods, it is possible to use shorter connecting rods and a better force distribution is attained.

DETAILED DESCRIPTION OF THE INVENTION

Figure 1:
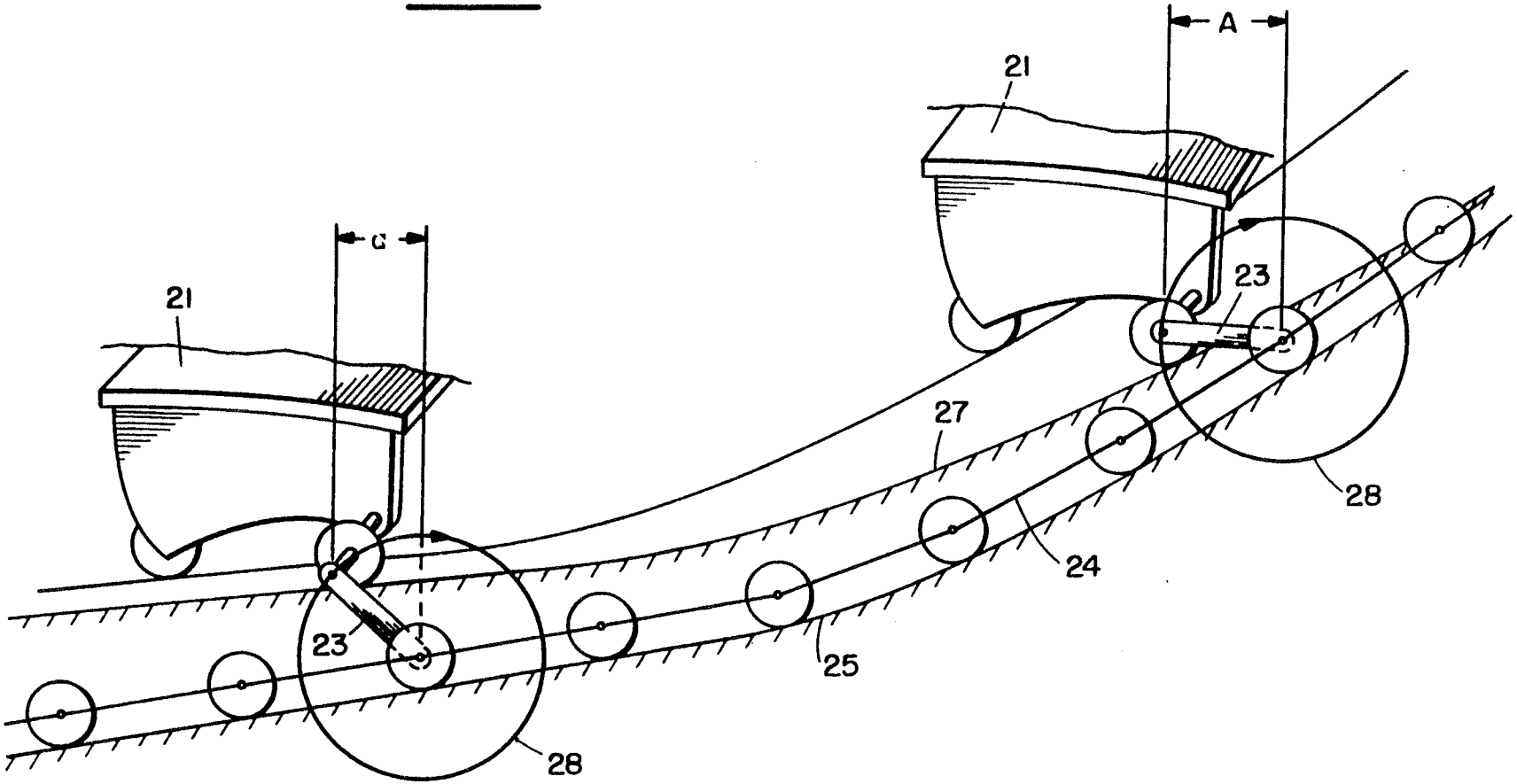
FIG. 1 is a schematic illustration of two steps 21 connected through their connecting rods 23 to the respective chain link 24 on the inner main track 25. A - a is the resulting horizontal displacement due to the rotation of the connecting rods.

In the description and in the drawings, the following symbols and abbreviations have the following meanings:

Vi inner path velocity
Va outer path velocity
Δi angle difference
Si distance interval on inner path
Sa distance interval on outer path
Δs horizontal distance difference inner path - outer path for Si - Sa
αi variable inner inclination angle
αa variable outer inclination angle
Ri inner radius of curved escalator
Ra outer radius of curved escalator
bi planar arc of the inner path measured from beginning of landing zone 1*c* ba planar arc of the outer path measured from beginning of landing zone 1*c*

The novel escalator of the present invention is based on the separation of chain path and step path of the apparatus, by means of connecting rods or links, to enable the steps to remain horizontal while attached to and travelling over vertically-spaced tracks.

The step track (27, 27') and the main track (25, 25') are connected at the side to the steps (21) and to horizontally and vertically rotatable links in the driving chains (24, 24') via connecting rods (23). They are displaced in the yaw axis by the vertical distance between main track (25, 25') and step track (27, 27'), but the rotation of the connecting rod (23) ensures that the step axis (29) is always exactly radial to the path of travel (1).

When, for the midsection or constant rising part 1*a* of the escalator, the formula:

$$\frac{Vi \cdot \cos(\alpha 1)}{Va \cdot \cos(\alpha a)} = \frac{Ri}{Ra}$$

is valid, then the angle velocities are the same. The steps do not push each other and run smoothly on a circular path.

In the transition zones 1*b* and 1*b'* from uniform inclination 1*a* to landing zones 1*c* and 1*c'*, which have no inclination, the angles $\alpha i$ and $\alpha a$ change so that the equation is no longer valid.

Due to the requirement that the steps in these zones must be horizontal, the inner and outer edges of the steps rotate about the yaw axis.

In the area of the landing zone 1*c*, equation 1 is not valid. There is a path displacement between inner and outer step edges, this being proportional to the factor $$f = \cos(\alpha i)/\cos(\alpha a).$$

Since the inner step edge proceeds the outer one it is necessary to shorten the chain link (24) connection by the same amount so that this difference can be compensated. This is not possible by means of a variable length chain link since such a link would be very complicated and links are not designed for such applications.

Since the main track 25 and the step track 27 are separated in the transition and landing zones, and the steps and chain links are connected via rotatable connecting rods 23, the present invention enables the steps and chains in these areas to travel at different velocities. The tracks must be so arranged that the steps retain a constant angle velocity relative to equation 1.

Figure 2:
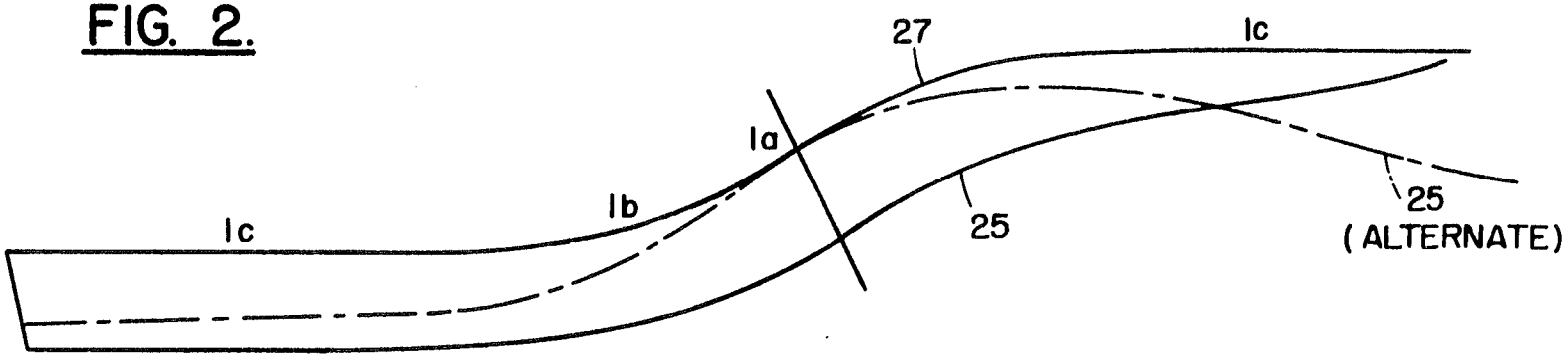
FIG. 2 is a schematic illustration of the main track 25 and the step track 27.
Figure 5:
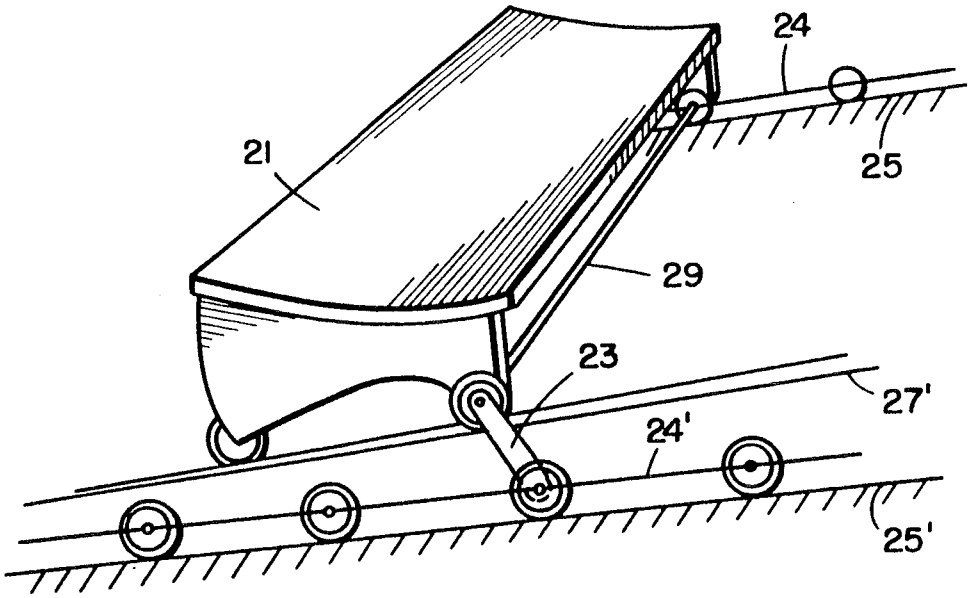
FIG. 5 is a schematic illustration of a step 21 which is connected through a connecting rod 23 to the chain link 24' on the main track 25.

This is achieved by (1) ensuring that the chain has a longer path (main track 25) than the steps (step track 27), as shown in FIG. 2; and (2) the rotation of the connecting rod 23 to compensate for the variation of the distance between step track 27 and main track 25. The step is displaced relative to the cosine of the angle of rotation by the amount A - a, as shown in FIG. 1.

This system allows a complete circular path for the steps in all sections of the circular escalator.

The following describes a method for the calculation of a curve for a chain guide on the inner path.

Method for calculating the main track

Equation 3 gives the relationship between the path velocities when, in the normally longest section 1*a* on the inner and outer main track 25, 25', the same angle velocity is to be found.

$$\frac{Vi}{Va} = \frac{Ri \cdot \cos(\alpha a)}{Ra \cdot \cos(\alpha i)} \quad (3)$$

Figure 3:
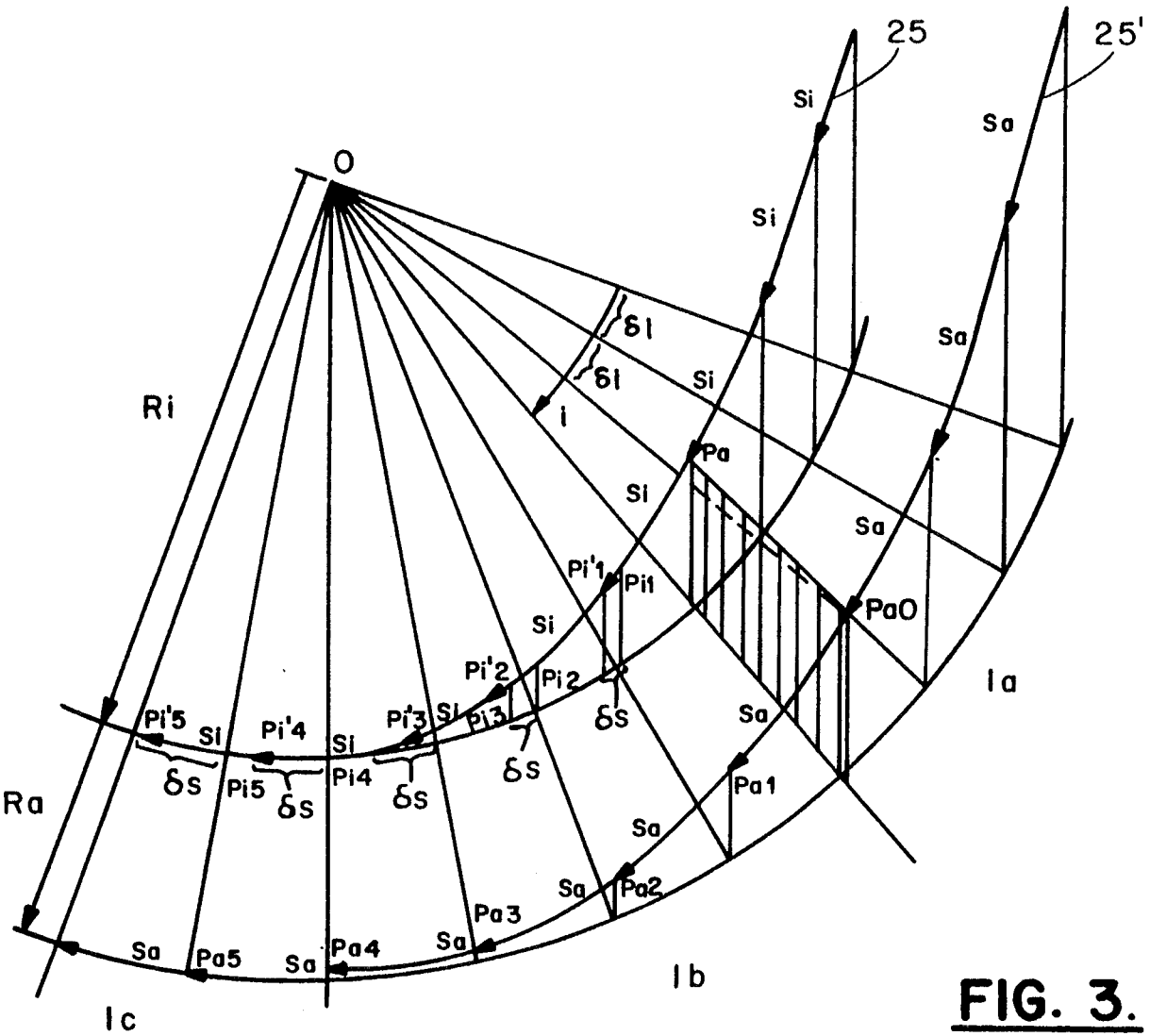
FIG. 3 is a schematic illustration, for the simultaneous relative sites of the inner and outer paths of the inner and outer step edges.

These path velocities are for the same time periods over the distances Si and Sa shown in FIG. 3.

If one transfers Si and Sa onto the path, one obtains synchronous running or similar angle velocities on the inner and outer paths in the zone 1*a* relative to the angle i. In the zones 1*b* and 1*c*, there is an angle difference relative to the horizontal path $\Delta s$, which increases continually For very small time intervals, the paths Sa and Si can be approximated as being linear. This results in the curve transforming to a polygonal character.

It is then possible, for example, to determine on the outer path the points Pa1 to Pa3 etc. by measuring (distance = Sa) from Pa0 and, corresponding by, for the same angle i, the points Pi1 to Pi3 etc. At these points one should find the inner edge of the steps when the outer edges are at Pa1, Pa2, etc.

According to equation 3 however, the inner edge of the steps should be at points Pi'1, Pi'2 etc. if the steps were rigidly connected to the chain. The points Pi'1 etc. are spaced by the respective distance Si from each other.

The present invention permits the step and chain paths to be different. The chain displacement in the same time period is Si, but the steps are not at Pi'1, Pi'2 etc. but are at Pi1, Pi2 etc. This causes the axis 29 of each step to remain radial to the path of travel 1 and prevents gaps from opening between the steps.

Figure 4:
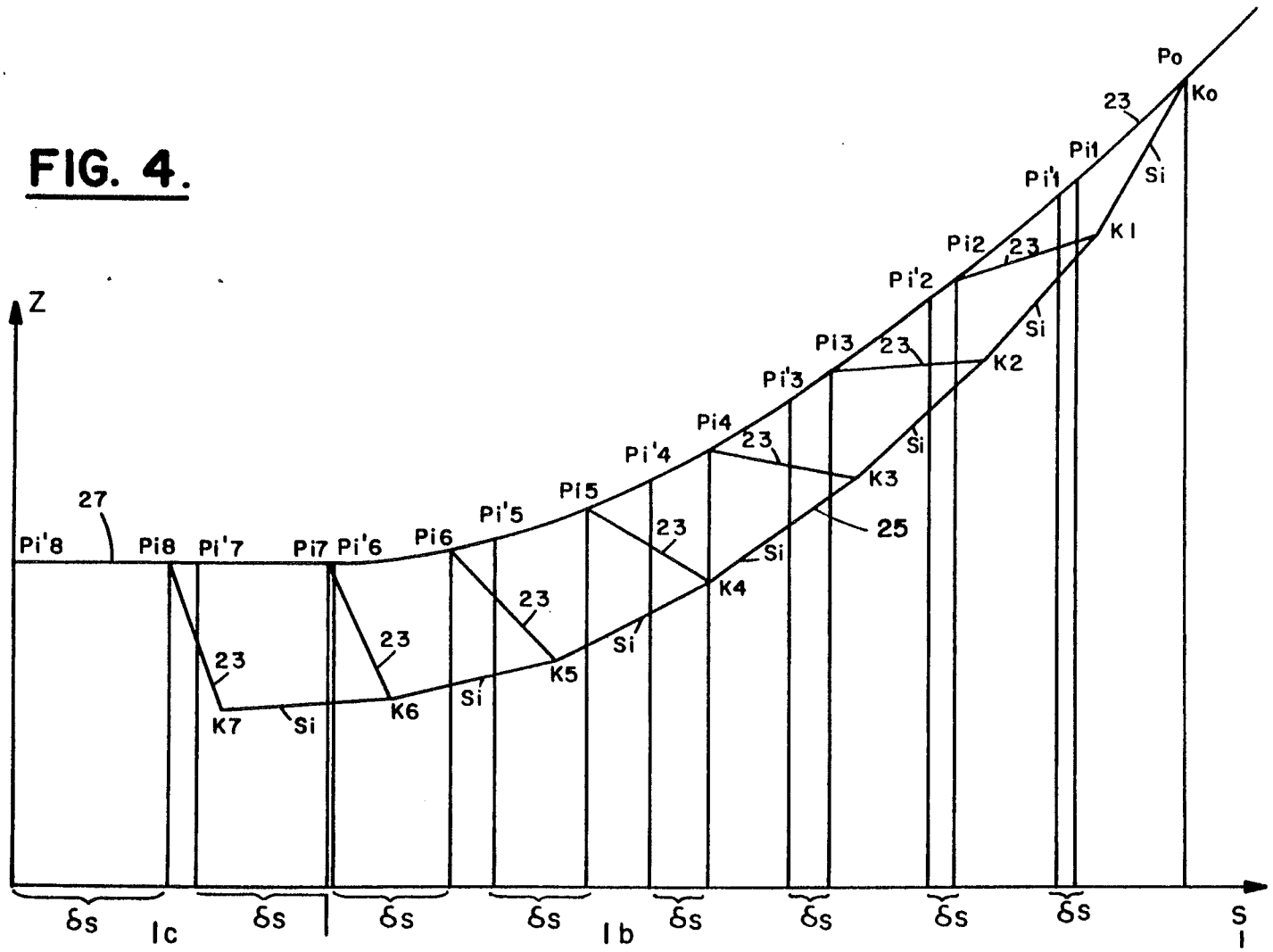
FIG. 4 illustrates, relative to FIG. 3, the possible determination of the positions of the connecting rods 23 as the main track becomes vertically lowered.
Figure 6:
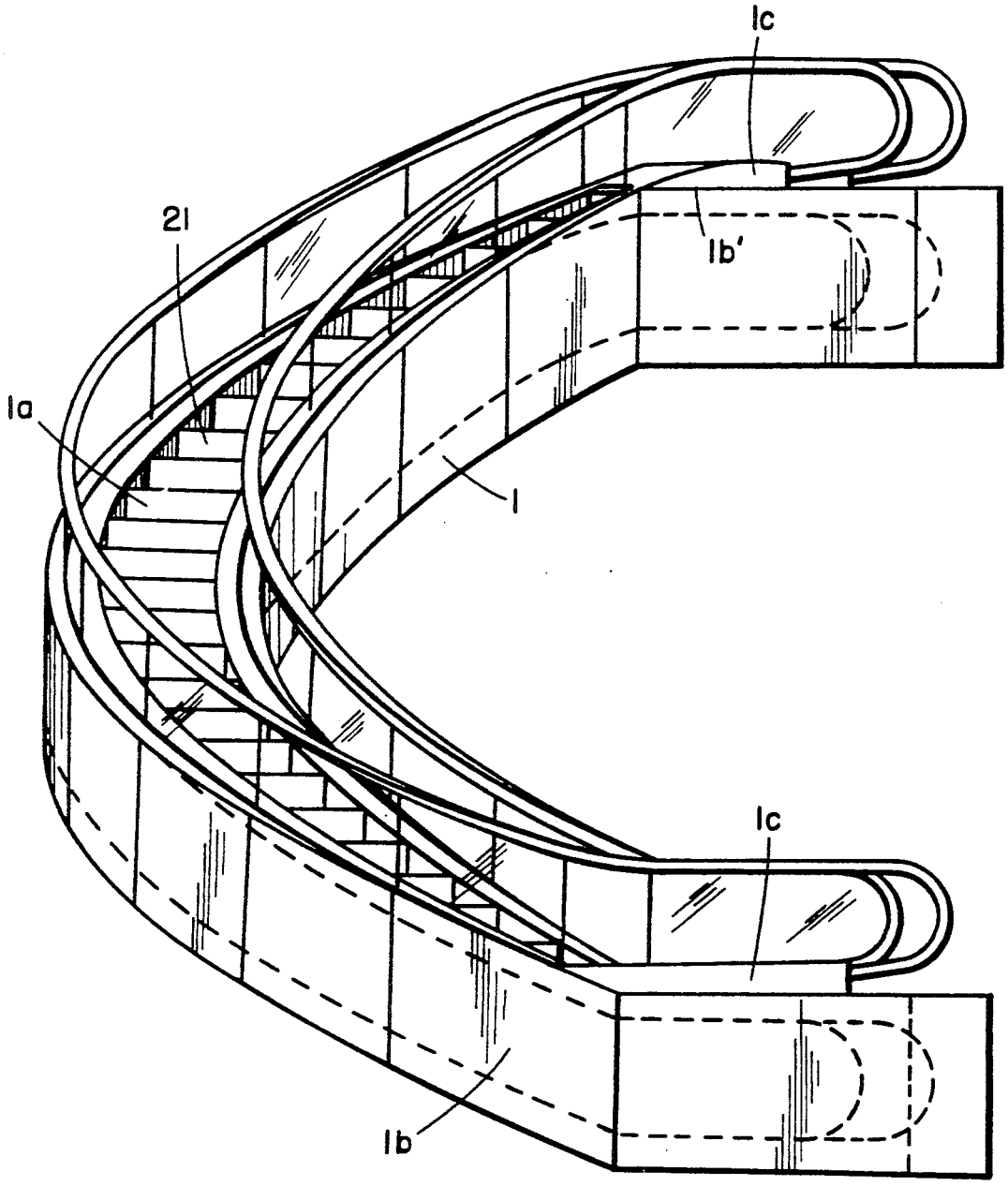
FIG. 6 is a perspective view of a curved escalator according to the present invention.
Figure 7:
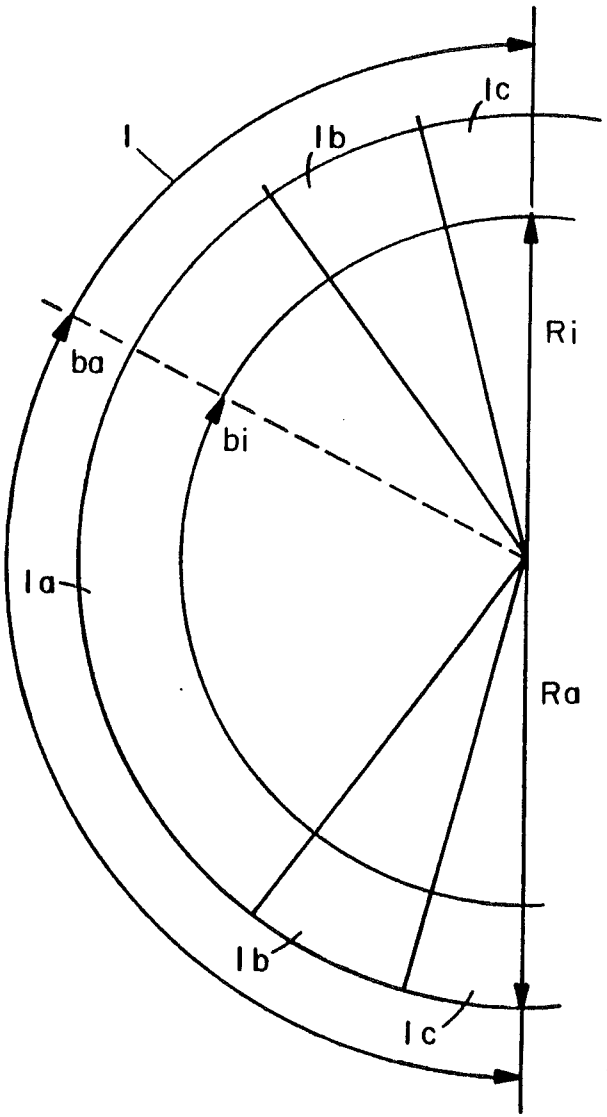
FIG. 7 is a plan view of the escalator of FIG. 6.

In FIG. 4, the inner step track 27 is shown with the points Pi1 to Pi8 as well as the points Pi'1 to Pi'7 which are spaced from one another by a distance Si. The path difference $\alpha s$ increases substantially from zone 1*a* to 1*c*.

The points K0 to K7 are points of the main track 25, and also show the different distances Si (corresponding to Pi'1 to Pi'8). Thus the path velocity of the inner main track is the same as the outer one according to equation 3. K0 is at the transfer point between zones 1*a* and 1*b*, and up to this point the main and step tracks could be the same, FIG. 2.

In order to ensure that the step is at the points Pi1, Pi2 etc., it is essential to connect the step with a rotatable connecting rod 23 to the chain.

The geometrical site of the main track point K1 is on the arc with Si from K0 and connecting rod 23 from Pi2. K2 is at the intersection of Si from K1 and connecting rod from Pi3. In this way it is possible to accurately determine all the points of the main track.

It is to be understood that the above described embodiments of the invention are illustrative only and that modifications throughout may occur to those skilled in the art. Accordingly, this invention is not to be regarded as limited to the embodiments disclosed herein but is to be limited as defined by the appended claims.

I claim:

1. An escalator comprising a plurality of movable steps supported on a parallel pair of inner and outer arced step tracks for movement along a curved path of travel, comprising a midsection of constant inclination, upper and lower landing zones having substantially no inclination and upper and lower transition zones which connect the midsection and the upper and lower landing zones, a spaced pair of inner and outer driving chains supported for movement along a spaced pair of main driving tracks spaced vertically below said step tracks, said chains being connected to the inner and outer edges of each of said steps to move said steps along said curved path of travel over said step rails, characterized by said main driving tracks defining a different curved arc than the step tracks in the transition zone and in the landing zones whereby the vertical distance between the main tracks and the step tracks is proportional to maintain the axis of each step radial to the path of travel and the cosine of the angle of inclination of the path of travel, and the difference in vertical distance of the displacement along the main tracks is compensated by rotatable connecting rods which connect the driving chains to the inner and outer edges of each of the steps and rotate the steps to maintain the axis of each step radial to the path of travel and prevent the formation of gaps therebetween during operation.

2. Curved escalator according to claim 1 wherein the degree of the vertical displacement of the step track and the main track is proportional to the width in the transfer from the horizontal zone through the transition zone midsection to the zone, whereby the formation of any gap between the steps is prevented.

3. Curved escalator according to claim 1 wherein the links of the driving chains are fully rotatable in both horizontal and vertical directions.

4. Curved escalator according to claim 1 wherein the steps on the inner and outer main tracks are connected by a connecting rod to links in the drive chain whereby the connection moves through a vertical circular path which is in a perpendicular plane relative to the steps.

5. Curved escalator according to claim 1 comprising step tracks and main driving tracks arranged horizontally displaced relative to each other whereby the degree of displacement is proportional to the normal gap width, the angle of inclination of the step and the length of the connecting rod.

* * * * *